United States Patent [19]

Blough et al.

[11] 4,042,998

[45] Aug. 23, 1977

[54] TEXTILE CLEANING

[75] Inventors: Ronald S. Blough, Sun City Center, Fla.; Virgil W. Cook, Charlotte, N.C.; Charles D. Spates, Fairfield, Iowa

[73] Assignee: American Chain & Cable Company, Inc., Bridgeport, Conn.

[21] Appl. No.: 601,658

[22] Filed: Aug. 4, 1975

[51] Int. Cl.[2] ..... A47L 9/20

[52] U.S. Cl. ..... 15/312 A; 15/346; 15/352

[58] Field of Search ..... 15/312 R, 312 A, 346, 15/352

[56] References Cited

U.S. PATENT DOCUMENTS

| | | | |
|---|---|---|---|
| 2,651,473 | 9/1953 | Siegenthaler | 15/312 R X |
| 3,011,205 | 12/1961 | Holtzclaw | 15/312 A |
| 3,086,240 | 4/1963 | Berberich et al. | 15/352 X |
| 3,086,891 | 4/1963 | McEachern | 15/352 X |
| 3,276,065 | 10/1966 | King, Jr. et al. | 15/312 A |

*Primary Examiner*—Christopher K. Moore
*Attorney, Agent, or Firm*—Barnes, Kisselle, Raisch & Choate

[57] ABSTRACT

A textile cleaning apparatus comprising a track adapted to extend along a row of textile machines, a carrier movable along the track, and means for driving the carrier along the track. The carrier includes blower means for directing a stream of air outwardly, conduit means associated with said blower means for directing at least one stream of air onto the textile machines as the carrier moves along the track, and air intake means associated with the blower means. The air intake means includes a chamber and a conduit communicating with the chamber and extending generally vertically alongside a row of machines. The conduit has an outer wall and a tubular filter within the conduit with means associated with the lower end of the filter for closing the space between the filter and conduit such that air drawn upwardly passes along the inner periphery of the filter. Valve means is associated with the filter to normally close the upper end of the filter. Means are associated with the upper end of the filter for closing the space between the filter and the conduit and cooperates with said valve means so that the air flowing upwardly in the filter passes through the filter in order to move out of the conduit into said chamber. Stationary means is provided along the path of the track and includes a clean-out station connected to a source of vacuum such that as the carrier moves past the clean-out station, the upper end of the conduit associated with said clean-out station is brought into register with the clean-out station and the valve means at the upper end of the filter is acutated to permit the material deposited on the interior of the filter to be drawn upwardly into the clean-out station.

7 Claims, 7 Drawing Figures

TEXTILE CLEANING

This invention relates to textile cleaning and particularly to apparatus for removing lint from textile machines and the area surrounding the textile machines.

BACKGROUND OF THE INVENTION

It has heretofore been suggested that lint and other fiber waste can be removed from textile machines by blowing currents of air on the machines and by utilizing vacuum to remove the lint from the floor and other areas of the machines. It has also been suggested that such apparatus can be moved along the row of machines to collect the fiber waste. Two types of such apparatus have been heretofore provided. In one type, the filters are periodically manually cleaned, while in another type, the filters are automatically cleaned as the apparatus is moved past a stationary clean-out station.

Where apparatus of the manual type has been provided and it is later necessary to convert to automatic clean-out, it has heretofore been necessary to replace the equipment. Such replacement obviously is costly and results in unnecessary discarding of equipment.

Among the objects of the invention is to provide a method and apparatus wherein lint collected by the textile cleaning apparatus may be automatically removed; wherein such apparatus utilizes novel means for collecting the lint; and wherein such apparatus is so constructed and arranged that it may be converted from an initial manual type of clean-out to an automatic clean-out at minimum cost and with minimum labor.

SUMMARY OF THE INVENTION

In accordance with the invention, the air intake means associated with said blower means includes a chamber and a conduit communicates with the chamber and extends generally vertically alongside a row of machines. The conduit has an outer wall and a tubular filter within the conduit with means associated with the lower end of the filter for closing the space between the filter and conduit such that air drawn upwardly through the conduit passes along the inner periphery of the filter. Means are associated with the upper end of the filter for closing the space between the filter and the conduit such that the air flowing upwardly in the filter must pass through the filter in order to move upwardly and outwardly. Valve means are associated with the filter to normally close the upper end of the filter. Stationary means is provided along the path of the track and includes a clean-out station connected to a source of vacuum such that as the carrier moves past the clean-out station, the upper end of the conduit associated with said clean-out station is brought into register with the clean-out station and the valve means at the upper end of the filter is actuated to permit the material deposited on the interior of the filter to be drawn upwardly into the clean-out station. The apparatus is such that it can be readily converted from a manual clean-out mode to the automatic clean-out mode described above.

DESCRIPTION

Figure 1:
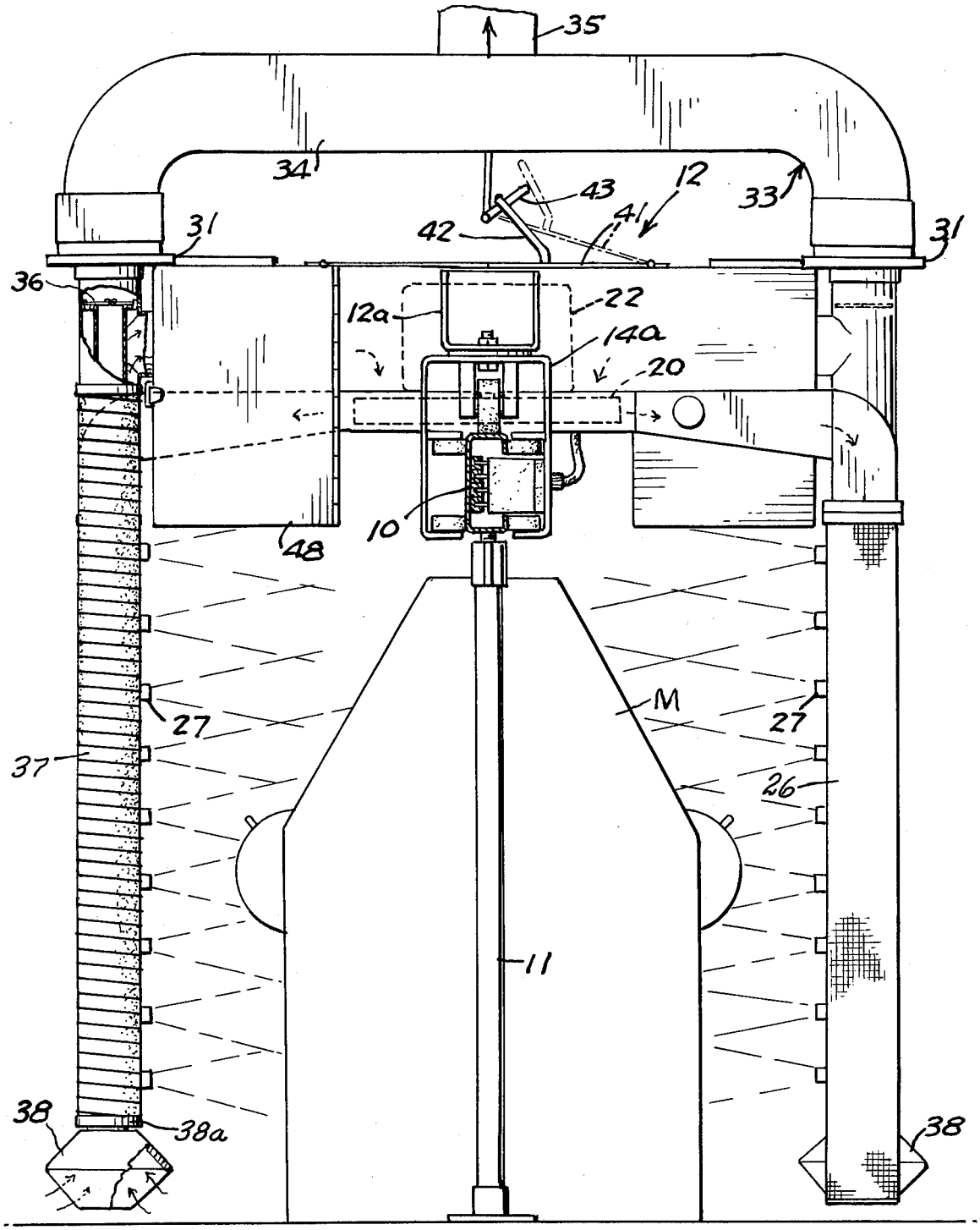
FIG. 1 is a part sectional vertical elevational view of an apparatus embodying the invention.
Figure 2:
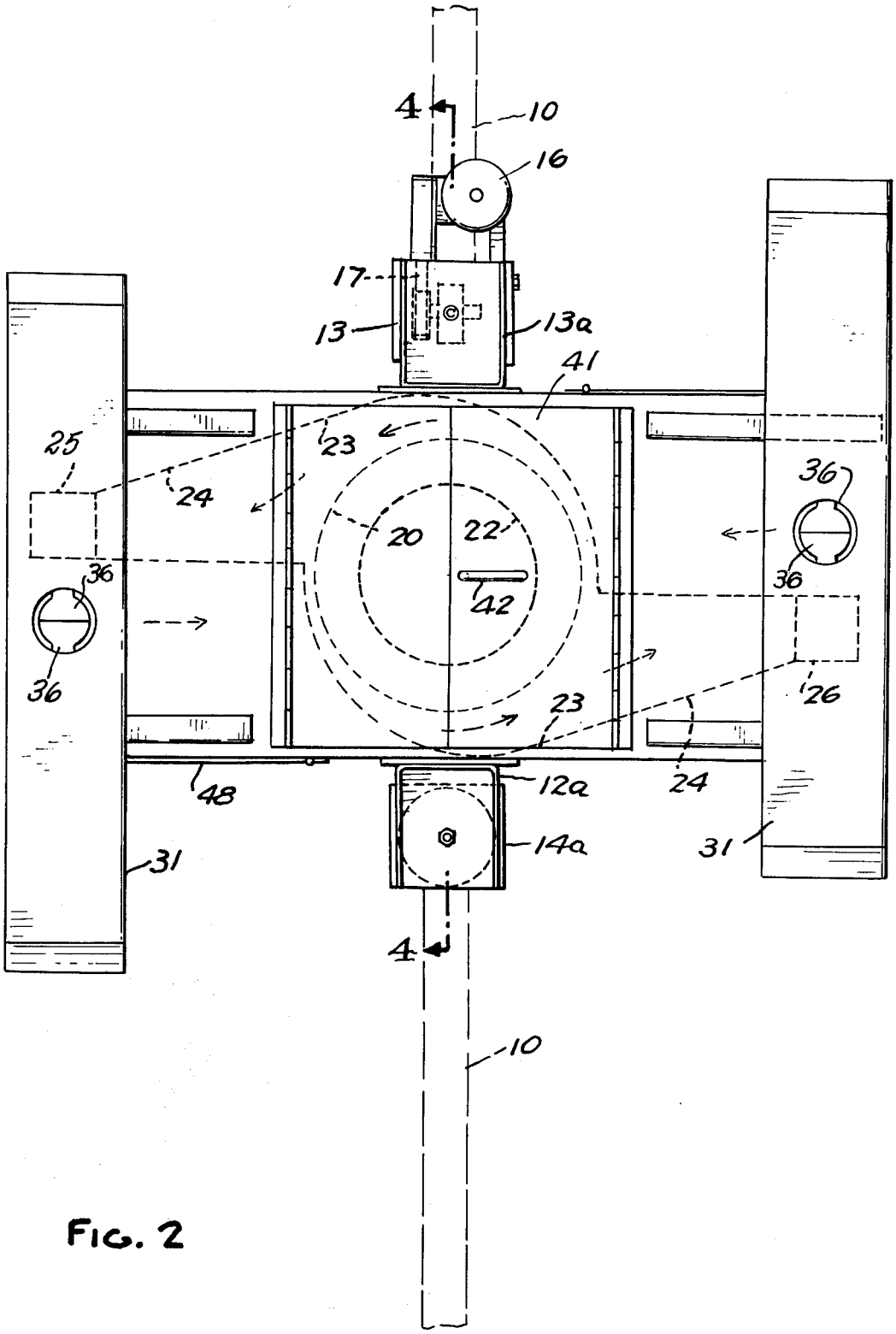
FIG. 2 is a fragmentary plan view of the apparatus.

Referring to FIGS. 1-6, the apparatus is adapted to clean fiber waste such as lint and the like from a plurality of textile machines M such as spinning frames. The apparatus is adapted to move along a track 10 which may be supported from the ceiling, from the machines, or from the floor as is well known and as herein shown from the floor by posts 11.

The apparatus includes wheel assemblies 13, 14 that are pivotally mounted on brackets **13*a*, 14*a*, about vertical axes by bearings 13*b*, 14*b*. Brackets 13*a*, 14*a* are bolted to a housing 15 to define a carrier which engages the track and supports the housing 15 for movement along the track. Wheel assembly 13 has a motor 16 and drive 17 that drives the carriage 12** periodically along the track. In the case where the apparatus is to be suspended from a track, the brackets are bolted to the housing and extend upwardly to the wheel assemblies.

Housing 15 includes a rectangular intake chamber 18 into which air is drawn as presently described to the intake 19 of a blower 20 operating in a blower chamber 21 driven by a motor 22. The chamber 21 includes walls 23 that define a scroll for directing air to a conduit 24. The outer ends of the conduits 24 communicate through elbows 25 with flexible tubes 26 that extend vertically along each side of the track and along the row of machines. Each tube 26 is provided with a plurality of nozzles 27 for directing air against specific portions of the machines M.

The intake to the chamber 18 is through a secondary chamber 28 that communicates freely with the chamber 18. The housing 15 further includes a rigid vertical conduit 29 that comprises an outer tube **29*a* and an inner tube 29*b*. The space between the upper end of the inner tube 29*b* and the inner wall of the tube 29*a* is closed by a spacer 40*a* (FIG. 6) and communicates with chamber 28 through an interconnecting conduit 30, thus forming a T connection to chamber 28. The upper end of outer tube 29*a* includes a horizontally extending panel 31 which is adapted to be engaged with a seal 32 of a stationary clean-out station 33 along the path of the textile cleaning apparatus. The station 33 includes pipes 34 extending to a pipe 35** which, in turn, connects a source of vacuum.

As presently described, when the apparatus moves past the cleaning station 33, the upper end of the conduit 29 is brought into communication with the source of vacuum. A normally closed flapper valve 36 is associated with the upper end of inner tube **29*b*** and is adapted to open when the conduit is brought into communication with the clean-out station.

The conduit 29 includes a flexible tube 37 that is connected at its upper end to the outer tube **29*a* by a suitable clamp and at its lower end to a flared nozzle 38 adjacent the floor by a suitable clamp. A tubular filter 39 is connected at its upper end by a suitable clamp 40*b* to inner tube 29*b* (FIG. 3) is such a manner that the space between the outer surface of the filter 39** and tube 37 is open at the upper end. An adaptor ring 38*a* is positioned between the lower end of tube 37 and filter 39 and the lower end of conduit 37 is closed and air can only flow upwardly through the interior of the filter 39. By such an arrangement, the vacuum created in the chamber 18 draws air upwardly through the nozzle 38 into the interior of the filter 39 and thereafter through the filter to the secondary or intermediate chamber 28 and then to the fan. Thus, the lint is continuously deposited upon the filter.

When the apparatus moves past the clean-out station, the vacuum at the clean-out station opens the valve 36 which normally closes the upper end of filter 39 so that the lint is removed and passes upwardly to the clean-out station.

In order to assist and provide a positive flow of air facilitating clean-out, a door 41 is provided on the upper end of the housing and is formed with an arm 42 that is adapted to engage a stationary cam 43 at the clean-out station to lift the door to the broken line position shown in FIG. 1, thereby causing outside or external air to enter the chamber 18 dissipating suction on conduit 29 by blower 20 to assist in providing a flow of air upwardly through the valve 36.

Thus, each time the carrier passes the clean-out station, the filter is cleaned.

Figure 3:
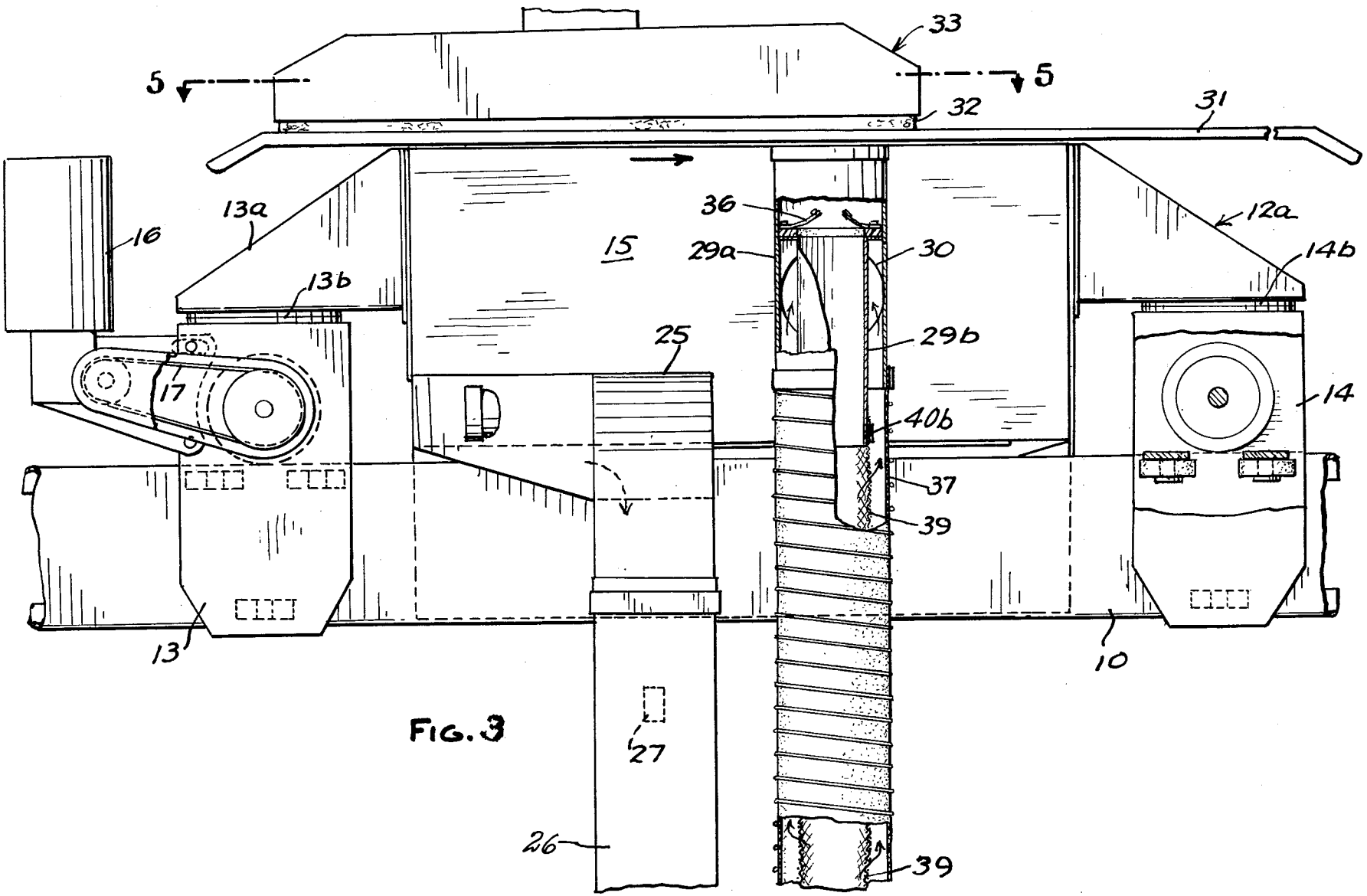
FIG. 3 is a fragmentary side elevational view on an enlarged scale of a portion of the apparatus shown in FIG. 1.
Figure 4:
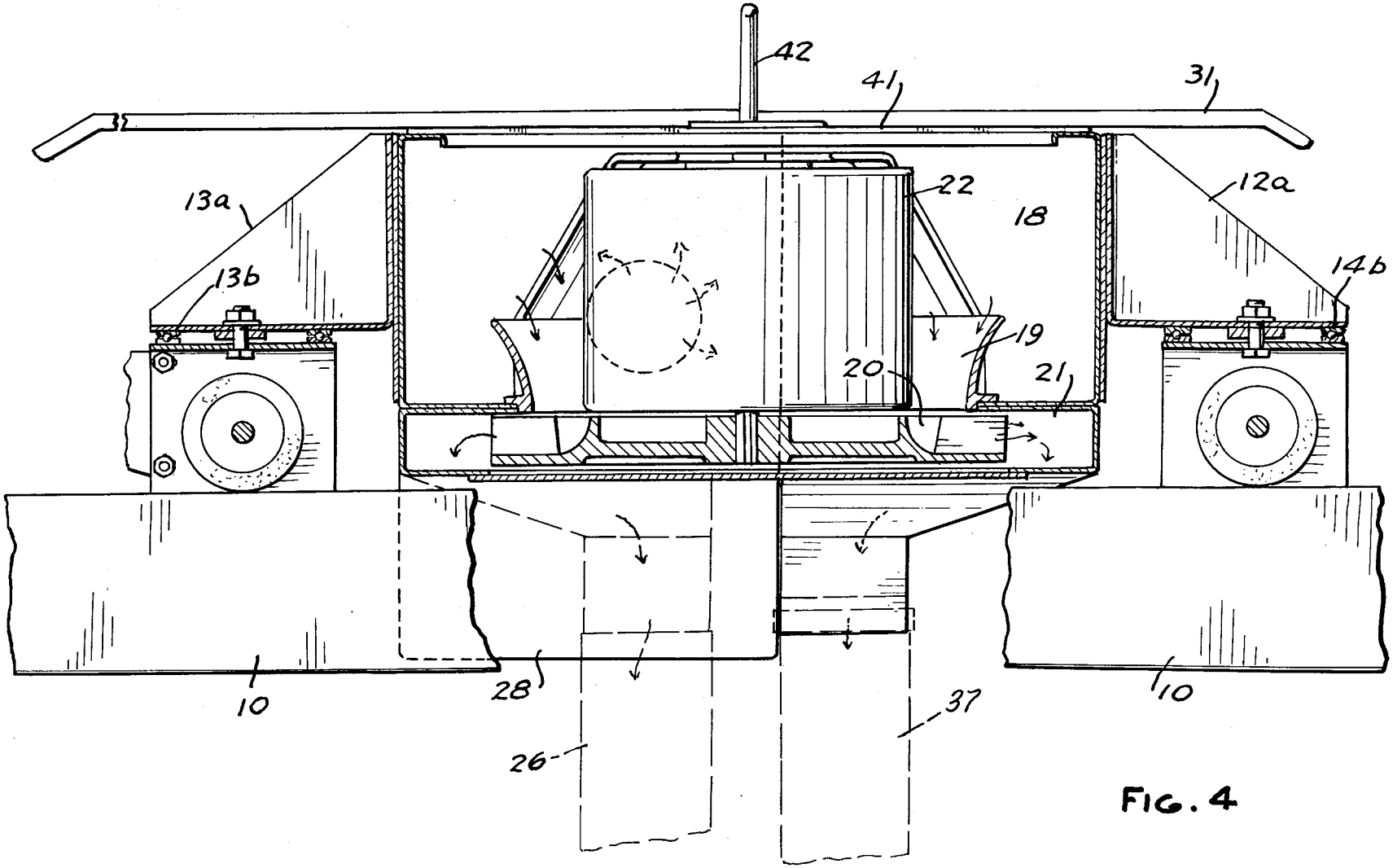
FIG. 4 is a fragmentary sectional view on an enlarged scale taken along the line 4—4 in FIG. 2.
Figure 5:
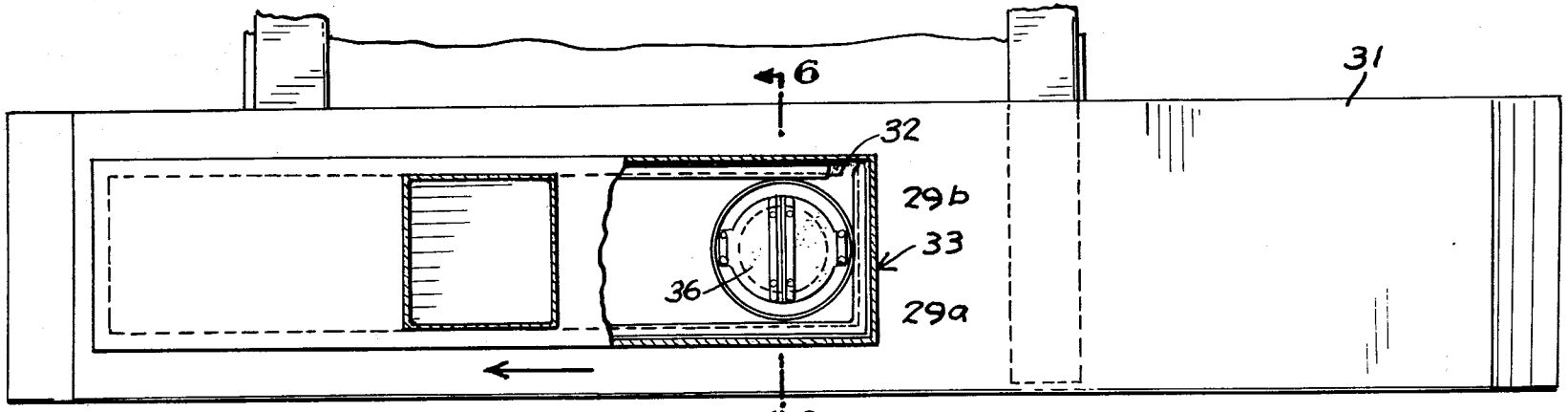
FIG. 5 is a fragmentary sectional view taken along the line 5—5 in FIG. 3.
Figure 6:
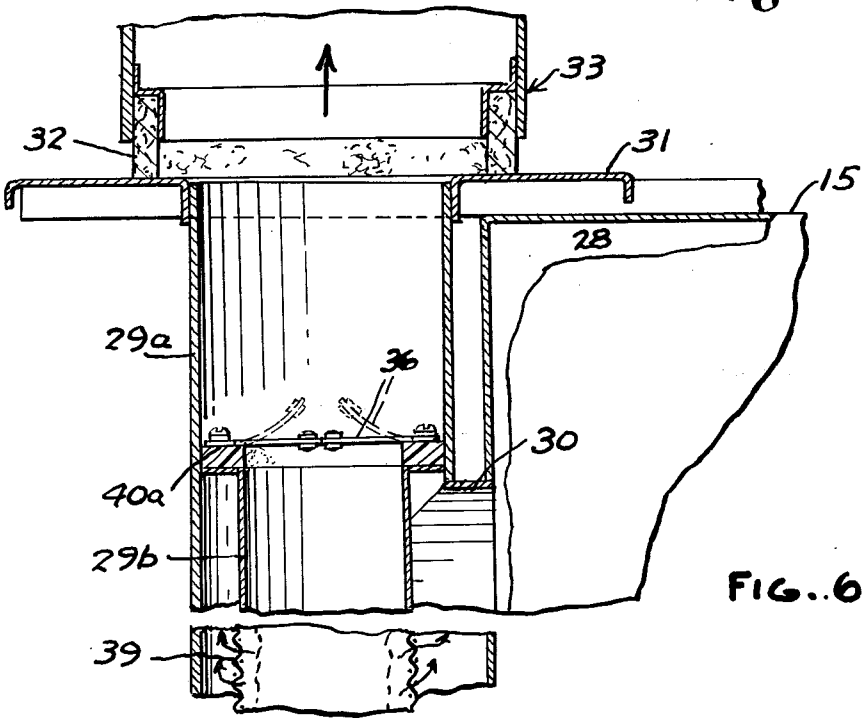
FIG. 6 is a fragmentary sectional view on an enlarged scale taken along the line 6—6 in FIG. 5.
Figure 7:
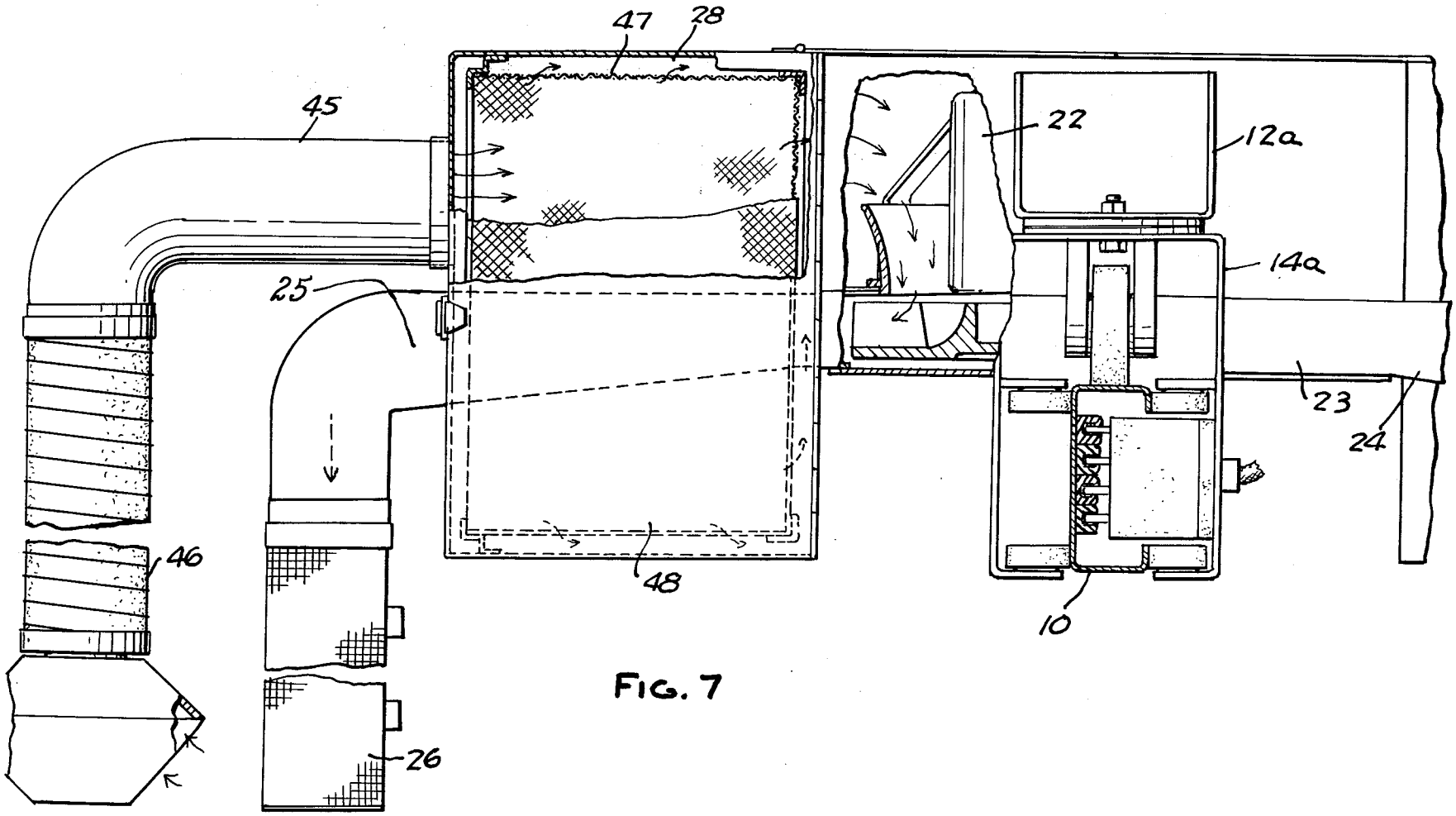
FIG. 7 is a fragmentary view similar to FIG. 6 showing the manner in which the apparatus may be readily converted to and from manual operation.

The apparatus shown is of the type such that, initially, where a central vacuum system is not available, the apparatus can be constructed for manual clean-out and can be later converted to automatic clean-out. Thus, for example, as shown in FIG. 3, initially, the T connection formed by conduits 29, 30 is replaced by an elbow 45 to a flexible tube 46 and a wire mesh box filter 47 is placed in and substantially fills the secondary chamber 28. The filter has an opening in one side to the interior thereof to provide communication with conduit 30. This apparatus can be operated and when the filter has sufficient lint or fiber waste thereon can be cleaned manually by opening the door 48 that is pivoted to one wall of the housing to define the chamber 28.

It can thus be seen that an apparatus has been provided which can in one mode serve for manual clean-out and by simple conversion be adapted to automatic clean-out.

We claim:

1. In a textile cleaning apparatus, the combination comprising a track, a carrier movable along said track adapted to extend along a row of textile machines, means for driving said carrier along said track, said carrier including blower means for directing a stream of air outwardly, conduit means associated with said blower means for directing at least one stream of air onto the textile machines as the carrier moves along said track, said carrier including air intake means associated with said blower means, said air intake means including a chamber, a connecting conduit communicating with said chamber and extending generally vertically alongside a row of machines, said conduit having an outer wall, a tubular filter within and spaced from said conduit with means associated with the lower end of the filter for closing the space between said filter and said conduit such that air and material drawn upwardly through the conduit pass along the inner periphery of the filter, valve means associated with the upper end of the filter, means associated with the upper end of the filter for closing the space between the filter and the conduit and cooperating with the valve means so that the air flowing upwardly through the interior of the filter must pass through the filter in order to move out of the conduit into said chamber, stationary means along the path of the track including a clean-out station connected to a source of vacuum such that as the carrier moves past the clean-out station, the upper end of the conduit associated with said clean-out station is brought into register with the clean-out station and the valve means at the upper end of the filter is actuated to permit the material deposited on the interior of the filter to be sucked upwardly into the clean-out station.

2. The combination set forth in claim 1 including means associated with said chamber for opening said chamber to the exterior to permit external air to pass through said chamber to said blower means and thereby assist in removal of the fiber waste from the interior of the filter.

3. The combination set forth in claim 2 wherein said last-mentioned means includes a door and means along said track for engaging said door to open said door and thereby permit external air to pass inwardly.

4. In a textile cleaning apparatus, the combination comprising blower means for directing a stream of air outwardly, conduit means associated with said blower means for directing at least one stream of air onto the textile machines, air intake means associated with said blower means, a connecting conduit communicating with said air intake means of said blower means and adapted to extend generally vertically alongside a row of machines, said conduit having an outer wall, a tubular filter within said conduit with means associated with the lower end of the filter for closing the space between said filter and said conduit such that air and material drawn upwardly through the conduit pass along the inner periphery of the filter, valve means associated with the upper end of the filter, means associated with the upper end of the filter for closing the space between the filter and the conduit and cooperating with said valve means so that the air flowing upwardly through the interior of the filter must pass through the filter in order to move out of the conduit into said air intake means, such that the upper end of the conduit may be brought into register with a clean-out station and the valve means at the upper end of the filter will be actuated to permit the material deposited on the interior of the filter to be sucked upwardly into the clean-out station.

5. The combination set forth in claim 4 including said air intake means including a chamber, and means associated with said air intake means for opening said chamber to the exterior to permit external air to pass through said air intake means to said blower means connecting conduit and thereby assist in removal of the fiber waste from the interior of the filter.

6. The combination set forth in claim 5 wherein said last-mentioned means includes a door adapted to be engaged by means along a track for engaging said door to open said door and thereby permit external air to pass inwardly.

7. For use in a textile cleaning apparatus comprising a track, a carrier movable along said track adapted to extend along a row of textile machines, means for driving said carrier along said track, said carrier including blower means for directing a stream of air outwardly, conduit means associated with said blower means for directing at least one stream of air onto the textile machines as the carrier moves along said track, said carrier including air intake means associated with said blower means, the combination wherein a first conduit selectively connectable with said air intake means and extending generally vertically alongside a row of machines, said conduit having an outer wall, a tubular filter within said conduit with means associated with the lower end of the filter for closing the space between said filter and said conduit such that air drawn upwardly through the conduit passes along the inner periphery of the filter, valve means associated with the upper end of the filter, means associated with the upper end of the filter for closing the space between the filter and the conduit and cooperating with said valve means so that the air flowing upwardly through the interior of the filter must pass through the filter in order to move out of the conduit into said air intake means, the upper end of the conduit may be brought into register with a clean-out station connected to a source of vacuum and the valve means at the upper end of the filter will be actuated to permit the material deposited on the interior of the filter to be sucked upwardly into the clean-out station.

* * * * *